US005822724A

United States Patent [19]

Nahumi

[11] Patent Number: 5,822,724

[45] Date of Patent: Oct. 13, 1998

[54] OPTIMIZED PULSE LOCATION IN CODEBOOK SEARCHING TECHNIQUES FOR SPEECH PROCESSING

[76] Inventor: Dror Nahumi, 49 Stonehenge Dr., Ocean, N.J. 07712

[21] Appl. No.: 518,354

[22] Filed: Jun. 14, 1995

[51] Int. Cl.[6] ..... G10L 9/14

[52] U.S. Cl. ..... 704/223; 704/219; 704/236

[58] Field of Search ..... 395/2.15, 2.31, 395/2.32, 2.33, 2.28, 2.38, 2.39, 2.47, 2.48, 2.71, 2.73; 704/219, 223, 236, 238, 239, 262, 264

[56] References Cited

U.S. PATENT DOCUMENTS

| | | | |
|---|---|---|---|
| 3,624,302 | 11/1971 | Atal | 179/1 SA |
| 4,701,954 | 10/1987 | Atal | 381/49 |
| 4,939,061 | 7/1990 | Kroon et al. | 704/223 |
| 4,964,169 | 10/1990 | Ono | 704/218 |
| 5,023,910 | 6/1991 | Thomson | 704/206 |
| 5,179,594 | 1/1993 | Yip et al. | 704/217 |
| 5,233,660 | 8/1993 | Chen | 704/208 |
| 5,265,190 | 11/1993 | Yip et al. | 704/219 |
| 5,307,441 | 4/1994 | Tzeng | 704/222 |
| 5,327,519 | 7/1994 | Hagqvist et al. | 704/219 |
| 5,327,520 | 7/1994 | Chen | 704/219 |
| 5,339,384 | 8/1994 | Chen | 395/2.2 |
| 5,371,853 | 12/1994 | Kao et al. | 704/223 |
| 5,444,816 | 8/1995 | Adoul et al. | 704/219 |
| 5,451,951 | 9/1995 | Elliott et al. | 341/155 |
| 5,615,298 | 3/1997 | Chen | 704/228 |
| 5,621,852 | 4/1997 | Lin | 704/219 |
| 5,754,976 | 5/1998 | Adoul et al. | 704/223 |

OTHER PUBLICATIONS

App.#: 07/990,309. Filing Date: Dec. 14, 1992 Applicant: Kleijn.

App.#: 08/234,504. Filing Date: Apr. 28, 1994 Applicant: Kleijn.

Claude Leflamme, Jean–Pierre Adoul, H. Y. Su and S. Morrisette, "On Reducing Computational Complexity of Codebook Search in CELP Coder Through the Use of Algebraic Codes", Proc. IEEE ICASSP 90, pp. 177–180, Apr. 1990.

*Primary Examiner*—David D. Knepper
*Assistant Examiner*—Tālivaldis Ivars Šmits
*Attorney, Agent, or Firm*—Steven Bartholomew

[57] ABSTRACT

Simplified methods of searching a codebook table are provided. These methods perform a codebook search for a plurality of pulses, one pulse at a time, in order of increasing to decreasing pulse significance, wherein pulse significance is defined as the relative contribution a given pulse provides to minimizing the mean-squared error between the source signal and the quantized sequence of pulses.

12 Claims, 3 Drawing Sheets

CODEBOOK TABLE 200

| SAMPLE NUMBER: PULSE VALUE | | | | | | | |
|---|---|---|---|---|---|---|---|
| 0 : +1 | 4 : 0 | 8 : 0 | 12 : 0 | 16 : 0 | 20 : 0 | 24 : 0 | 28 : 0 |
| 1 : 0 | 5 : 0 | 9 : −1 | 13 : 0 | 17 : 0 | 21 : 0 | 25 : 0 | 29 : 0 |
| 2 : 0 | 6 : 0 | 10 : 0 | 14 : 0 | 18 : +1 | 22 : 0 | 26 : 0 | 30 : 0 |
| 3 : 0 | 7 : 0 | 11 : −1 | 15 : 0 | 19 : 0 | 23 : 0 | 27 : 0 | 31 : 0 |

PERMISSIONS TABLE 300

| SAMPLE NUMBER: PERMISSIONS | | | | | | | |
|---|---|---|---|---|---|---|---|
| 0 : 1 | 4 : 1 | 8 : 1 | 12 : 1 | 16 : 1 | 20 : 1 | 24 : 1 | 28 : 1 |
| 1 : 0 | 5 : 0 | 9 : 0 | 13 : 0 | 17 : 0 | 21 : 0 | 25 : 0 | 29 : 0 |
| 2 : 1 | 6 : 1 | 10 : 1 | 14 : 1 | 18 : 1 | 22 : 1 | 26 : 1 | 30 : 1 |
| 3 : 0 | 7 : 0 | 11 : 0 | 15 : 0 | 19 : 0 | 23 : 0 | 27 : 0 | 31 : 0 |

TYPICAL RESPONSE OF PERCEPTUALLY WEIGHTED FILTER 112 (FIG. 1)

OPTIMIZED PULSE LOCATION IN CODEBOOK SEARCHING TECHNIQUES FOR SPEECH PROCESSING

BACKGROUND OF THE INVENTION

1. Field of the Invention

This invention relates generally to speech analysis and more particularly to linear predictive speech pattern analyzers which utilize one or more codebook tables.

2. Description of Prior Art

Linear predictive coding (LPC) has been employed in conjunction with techniques such as digital speech transmission, speech recognition, and speech synthesis. LPC coding improves the efficiency of speech processing techniques by representing a speech signal in the form of one or more speech parameters. For example, a first speech parameter may be selected to represent the shape of the human vocal tract, and a second parameter may be selected to represent vocal tract excitation. The bandwidth occupied by the speech parameters is substantially less than the bandwidth occupied by the original speech signal.

The LPC coding technique partitions speech parameters into a sequence of time frame intervals, wherein each frame has a duration in the range of 5 to 20 milliseconds. The speech parameters are applied to a linear predictive filter which models the human vocal tract. Responsive to speech parameters representing the excitation to be applied to the human vocal tract, the linear predictive filter reconstructs a replica of the original speech signal. Systems illustrative of such arrangements are described in U.S. Pat. No. 3,624,302 and U.S. Pat. No. 4,701,954, both of which issued to B. S. Atal.

Speech parameters representing vocal tract excitation may take the form of pitch delay signals for voiced speech and noise signals for unvoiced speech. A predictive residual excitation signal is utilized to represent the difference between the actual speech signal used to generate a given frame and the speech signal produced in response to the LPC parameters stored in this frame. Due to the fact that the predictive residual corresponds to the unpredicted portions of the speech signal, this residual signal is somewhat noiselike, and occupies a relatively wide bandwidth.

It is possible to limit the bandwidth assigned to the quantized residual signal. One way is to simulate the residual signal, for each successive frame, with a multi-pulse signal that is constructed from a plurality of pulses by considering the differences between the original speech signal corresponding to a given frame and a speech signal derived from LPC parameters. The bit rate of the multi-pulse signal which is used to quantize the predictive residual may be selected to conform to proscribed transmission and storage requirements.

Assuming that the residual signal of a frame is represented by 32 samples, the constructed multi-pulse signal may, for example, comprise 32 pulses. The 32 pulses may be conceptualized as a vector having a size of 32, and this vector can be retrieved from a "vector table". When the number of entries in such a table is very large, as in the present case, the table entries are constructed "on the fly", i.e., in real time, and there is no actual table, but aritsans still speak in terms of codebook table entry searches.

The vector may also be conceptualized as a 4-row by 8-column, two-dimensional array, wherein the first column includes sample positions 0, 1, 2, and 3, the second column includes sample positions 4, 5, 6, and 7, and so on, and the eighth column includes sample positions 28, 29, 30, and 31. This is just for conveniece in arbitrarily limiting the degrees of freedom of the vector, as will be shown below. At each sample position, a value is stored that represents the presence or absence of a pulse at that sample location within the vector. This stored value is 1 if a positive-going pulse is present, 0 if no pulse is present, or −1 if a negative-going pulse is present.

The process of determining appropriate values for each of the sample locations may be referred to as a codebook table "search". One existing method of performing a codebook "search", which can be termed the "brute force" approach, assigns every possible combination of values to the sample positions, and selects the best combination of sample positions having the minimum mean-squared error between the actual speech signal and a speech signal reconstructed from LPC parameters. The process of minimizing this mean-squared error may also be referred to as waveform matching. The actual mean-squared error may be measured or, alternatively, a perceptually-weighted mean-squared error may be measured, such that the reconstructed signal is passed through an appropriate weighting filter before the error is measured.

An example of the brute-force approach is as follows. Assume that only one pulse is allowed at each horizontal line (in the two dimensional representation of the vector). Start at sample positions 0, 1, 2, and 3. Assume that positive-going pulses are present at each of these sample locations, and then measure the mean-squared error between the original speech signal and the speech signal reconstructed from the LPC parameters. Next, assume that negative-going pulses are present at each of these sample locations, measure the mean-squared error, etc. Note that there are 17 possible combinations of values for each horizontal row of sample positions. These 17 combinations are no pulse, a positive pulse in any one of 8 possible positions, and a negative pulse in any one of 8 possible positions. Since there are four horizontal rows to consider, a total of 17 to the fourth power (83,521) searches are required in order to complete a codebook search using the brute-force approach. Such an approach places heavy demands on the computational capacity of system hardware. In addition, processing speed may suffer.

Another existing method of searching a codebook table of pulses is by relaxing the waveform matching performance of the codebook "searching" procedure, thereby increasing the amount of mean-squared error. By way of an example, when the pulses are assumed to be "orthogonal" (i.e., a given pulse is considered to have no effect on any other pulse), the search commences within a given row of a codebook table. All possible combinations of −1, 0, and 1 are placed into the sample positions within this given row, the combination yielding the minimum mean squared error is selected, and the procedure is repeated for the next row until all rows have been considered. A total of only (17 * 4) searches are required (i.e., 68 searches). This procedure may result in inaccurate or sub-optimal results, depending upon the impulse response of a perceptual weighting filter, if such a filter is employed. The structure and functionality of perceptual weighting filters will be described hereinafter in connection with FIG. 4.

In the case where the mean-squared error is weighted by a perceptual filter, virtually all practical filter designs provide a certain amount of undesired "ringing". This "ringing" means that the filter exhibits a response at sample positions that occur subsequent to a sample position including a pulse. As a result, the codebook search may erroneously place pulses at sample positions where no pulse should be placed, thereby degrading system performance. What is needed is a codebook search technique that combines the computational expediency of the relaxed-performance search with an accuracy close to that of the brute-force approach.

SUMMARY OF THE INVENTION

In a speech coding system which encodes speech parameters into a plurality of temporally successive frames, a multi-pulse vector is synthesized from each frame to serve as a residual signal specifier. The multi-pulse vector specifies the temporal relationships of a plurality of pulses corresponding to a given frame, and includes a plurality of sample positions. At each sample position, a value is stored that represents the presence, absence, and/or sign of a pulse at that sample location within the vector. The locations of a plurality of pulses within a given multi-pulse vector are optimized to minimize a mean-squared error, also referred to as a waveform matching error, between a source signal and a quantized sequence of pulses represented by the multi-pulse vector. Alternatively, the pulse locations may be optimized to minimize the perceptually-weighted mean-squared error between the source signal and the quantized sequence of pulses. The optimization of pulse locations is referred to as a codebook table search.

According to the embodiment disclosed herein, a simplified method of searching a codebook table is provided. This method performs a search for a plurality of pulses, one pulse at a time, in order of increasing to decreasing pulse significance, wherein pulse significance is defined as the relative contribution a given pulse provides to minimizing the mean-squared error between the source signal and the quantized sequence of pulses.

DETAILED DESCRIPTION OF THE PREFERRED EMBODIMENTS

Figure 1:
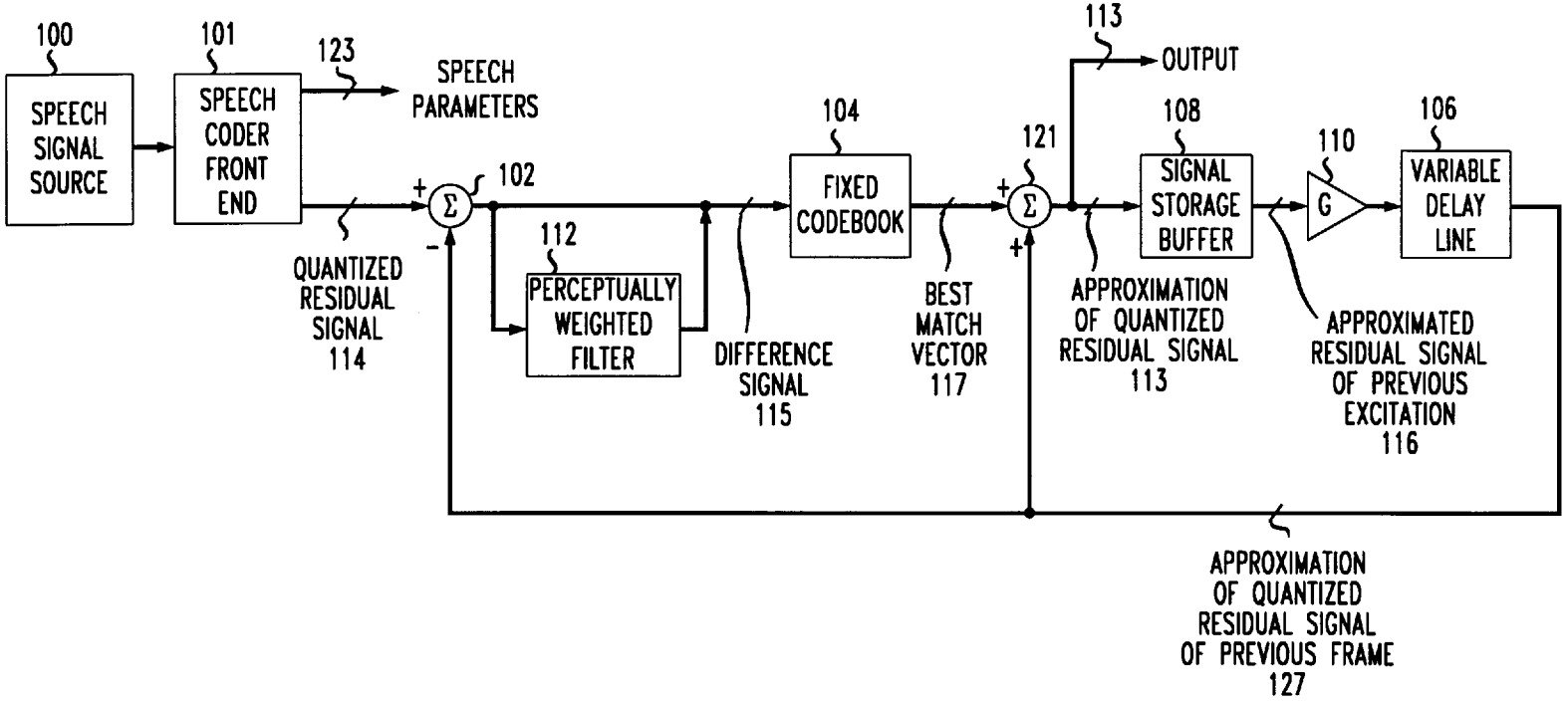
FIG. 1 is a hardware block diagram setting forth the overall operational environment of the codebook table searching techniques disclosed herein.

FIG. 1 is a hardware block diagram setting forth the overall operational environment of the codebook table searching techniques disclosed herein. A speech signal source 100 is coupled to a conventional speech coder front end 101. Speech coder front end 101 may include elements such as an analog-to-digital converter, one or more frequency-selective filters, digital sampling circuitry, and/or a linear predictive coder (LPC). For example, speech coder 101 may comprise an LPC of the type described in U.S. Pat. No. 5,339,384, issued to Chen et al., and assigned to the assignee of the present patent application.

Irrespective of the specific internal structure of speech coder front end 101, this coder produces a first output signal in a domain different from that of the original input speech signal. An example of such a domain is the residual domain, in which case the first output signal is a quantized residual signal 114. The speech coder front end 101 also provides a second output in the form of one or more speech parameters 123. The output signal from the speech coder front end 101 is organized into temporally-successive frames. In the present example, the output of speech coder 101 includes a quantized residual signal 114 in the residual domain. The quantized residual signal 114 specifies the signal to be quantized in order to minimize the waveform matching error between a difference signal 115 and a best match vector 117.

The quantized residual signal 114 is coupled to a first, non-inverting input of a first summer circuit 102. The output of first summer circuit 102, comprising a difference signal 115, is fed to fixed codebook 104. Alternatively, the output of first summer circuit 102 may be processed by an optional perceptually weighted filter 112 before this output is fed to the fixed codebook 104 as a difference signal 115. The perceptually weighted filter 112 transforms the output signal of summer circuit 102 to place greater emphasis on portions of this output signal that have a relatively significant impact on human perception, and a correspondingly lesser emphasis on those portions of this output signal that have a relatively insignificant impact on human perception. A best match vector 117 is retrieved from fixed codebook 104 based upon the value of the difference signal 115.

The best match vector 117 is fed to a first, noninverting input of a second summer 121. The output of second summer 121, in the form of an approximation of the quantized residual signal 113, is fed to a signal storage buffer 108. The approximation of the quantized residual signal 113 may be conceptualized as representing the output of the configuration of FIG. 1. Signal storage buffer 108 stores approximations of quantized residual signals 113 corresponding to one or more previous frames such as, for example, the frame immediately preceding a given frame. The output 116 of signal storage buffer 108 represents an approximated residual signal for a previous excitation of the quantized residual signal 114. Output 116 is coupled to a variable-gain amplifier 110, and the output of variable-gain amplifier 110 is processed by a variable delay line 106 that is equipped to apply a selected amount of temporal delay to the output of variable-gain amplifier 110. The output of variable delay line 106 represents an approximation of the quantized residual signal of the previous frame 127. This approximation of quantized signal of previous frame 127 is applied to a second, inverting, input of first summer circuit 102, and also to a second, noninverting input of second summer 121.

The output of first summer circuit 102 is a difference signal 115 which is used to index a fixed codebook 104. Fixed codebook 104 includes one or more multi-pulse vectors. Each multi-pulse vector specifies the temporal relationships of a plurality of pulses corresponding to a given frame. It is possible to arrange the vector in any number of configurations. In this example, the vector is arranged in an m-row by n-column, two-dimensional array, each location within the array specifying a sample position. At each sample position, a value is stored that represents the presence, absence, and/or sign of a pulse at that sample location within the vector. The organizational topology of an illustrative fixed codebook is described in the European GSM (Global System for Mobile) standard and the IS54 standard. Codebook indices are used to index fixed codebook 104. The values retrieved from fixed codebook 104 represent an extracted excitation code vector. The extracted code vector is that which was determined by the encoder to be the best match with the original speech signal. Each extracted code vector may be scaled and/or normalized using conventional gain amplification circuitry.

Figures 2, 3, 4:
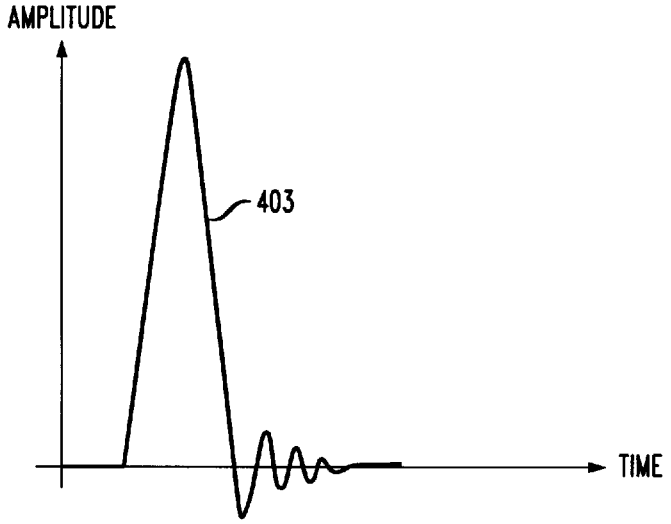
FIG. 2 is a data structure diagram setting forth an illustrative codebook table utilized in conjunction with a preferred embodiment disclosed herein.
FIG. 3 is a data structure diagram setting forth an illustrative permissions table utilized in conjunction with a preferred embodiment disclosed herein.
FIG. 4 sets forth a typical filter response for a practical perceptual filter design.

FIG. 2 is a data structure diagram setting forth an illustrative codebook table 200 utilized in conjunction with a preferred embodiment disclosed herein. The codebook table 200 associates each of a plurality of sample numbers with corresponding pulse values. In this manner, each codebook table 200 specifies the temporal relationships of a plurality of pulses corresponding to a given frame. The table is arranged in a 4-row by 8-column, two-dimensional array, each location within the array specifying a sample position. Although a 4×8 array is shown in the present example for purposes of illustration, an array of any convenient dimensions or structure may be employed.

At each sample position, a value is stored that represents the presence, absence, and/or sign of a pulse at that sample location within the vector. In the present example, a value of +1 signifies the presence of a positive-going pulse, a value of −1 signifies the presence of a negative-going pulse, and a value of 0 signifies the absence of a pulse. For example, positive-going pulses are at sample locations 0 and 18. Negative-going pulses are at sample locations 9 and 11, and the remaining sample locations do not include any pulses.

In order to improve the inherent coding efficiency of the codebook table, constraints may be placed on the sample locations that are allowed to include pulses. For example, one illustrative constraint prohibits the existence of more than one pulse on any given horizontal row of the codebook table 200. Another illustrative constraint prohibits the existence of pulses at immediately adjacent (i.e., adjoining) sample locations. One or more constraints may be incorporated into a permissions table 300, thereby providing an efficient technique for applying the constraints in the context of a codebook table search.

If the optional perceptually weighted filter 112 is employed, virtually all practical filter designs provide an impulse response that rings to successive pulses, as is described in greater detail hereinafter with respect to FIG. 4. Under these circumstances, an accurate codebook search appears to require the summation of all possible pulse locations. If a codebook table 200 as shown in FIG. 2 is utilized, and a constraint of only one pulse in each horizontal row of the codebook table 200 is applied, then the search requires a maximum of 17 to the fourth power searches. Note that each sample location can take on one of three possible values, such as −1, 0, or 1. Even though this technique provides the best overall waveform match, that is, the waveform match having the lowest mean-squared error, such an exhaustive search is too complex and resource-intensive for many practical applications. Therefore, according to various preferred embodiments disclosed herein, an improved search procedure is utilized that replaces the aforementioned exhaustive search with a sequential pulse search.

The improved search procedures disclosed herein are applicable to speech coding systems which encode speech parameters into a plurality of temporally successive frames. A multi-pulse vector is synthesized from each frame. The multi-pulse vector specifies the temporal relationships of a plurality of pulses corresponding to a given frame, and includes a plurality of sample positions. At each sample position, a value is stored that represents the presence, absence, and/or sign of a pulse at that sample location within the vector. The locations of a plurality of pulses within a given multi-pulse vector are optimized to minimize a mean-squared error, also referred to as a waveform matching error, between a source signal and a quantized sequence of pulses represented by the multi-pulse vector. Alternatively, the pulse locations may be optimized to minimize the perceptually-weighted mean-squared error between the source signal and the quantized sequence of pulses. The optimization of pulse locations is referred to as a codebook table search.

According to various embodiments disclosed herein, simplified methods of searching a codebook table are provided. These methods perform a codebook search for a plurality of pulses, one pulse at a time, in order of increasing to decreasing pulse significance, wherein pulse significance is defined as the relative contribution a given pulse provides to minimizing the mean-squared error between the source signal and the quantized sequence of pulses.

FIG. 3 is a data structure diagram setting forth a permissions table utilized in conjunction with a preferred embodiment disclosed herein. The permissions table 300 associates each of the sample locations with a corresponding enable/disable bit. Sample location 4 is associated with an enable/disable bit value of 1, effectively enabling sample location 4 as a potential location for a pulse. Sample location 5 is associated with an enable/disable bit value of 0, signifying that a pulse can no longer be added to this sample location.

A given sample location is either enabled or disabled at any given moment in time. During a codebook table search, as the sample locations that are to include pulses are determined, the enable/disable bits for the sample locations are set. The enable/disable bits are set in accordance with the constraints to be implemented. For example, assume that only one pulse is allowed per each horizontal row. Once a given codebook search determines that a pulse of −1 should be situated at sample location 9, the permissions table 300 is loaded with zeroes across the entire horizontal row that includes sample location 9, thereby eliminating this row from further consideration as a potential site for pulse locations. However, once a new codebook search is commenced, the entire permissions table is initialized by setting all locations to 1, thereby enabling all locations.

FIG. 4 sets forth an illustrative filter response 403 for a practical perceptual filter design. Note that, subsequent to the occurrence of a pulse, the amplitude of the filter output does not immediately return to zero. Rather, the filter output rings, i.e., exhibits a non-zero response, after the trailing edge of a received pulse has terminated.

Figure 5:
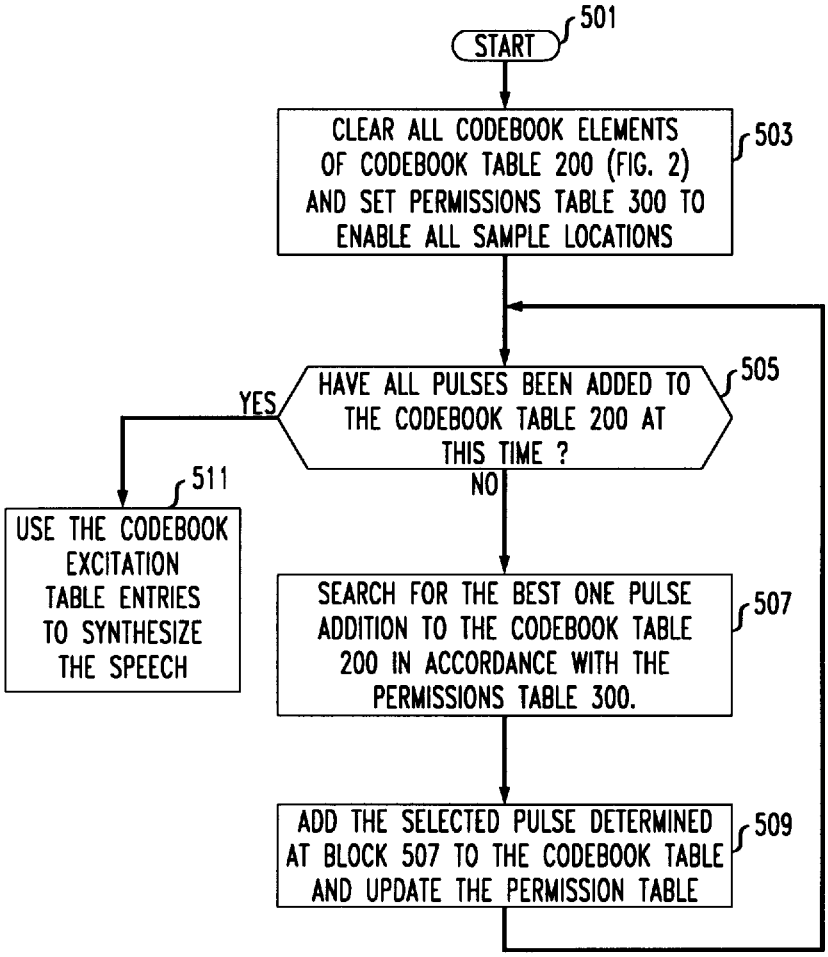
FIG. 5 is a software flowchart setting forth a method of codebook table optimization according to a preferred embodiment disclosed herein.

FIG. 5 is a software flowchart setting forth a method of codebook table optimization according to a preferred embodiment disclosed herein. The program commences at block 501. At block 503, the codebook elements (sample locations) of codebook table 200 (FIG. 2) are cleared and the permission table is set to enable all samples. This step may be performed by setting all sample locations to zero. Next (block 505), a test is performed to ascertain whether or not all pulses have been added to the codebook table 200 at this time. If so, the program progresses to block 511, where entries in a conventional codebook excitation table of a conventional speech coding system are used to synthesize speech.

The negative branch from block 505 leads to block 507, where a search is performed to locate the one best pulse addition to the codebook table 200. This search may, but need not, be performed in accordance with any constraints set forth in permissions table 300. The selected pulse determined at block 507 is added to the codebook table 200 at block 509. Also at block 509, if a permissions table is used, the permissions table is updated at this time. The program then loops back to block 505.

The invention claimed is:

1. In a speech coding system utilizing a fixed codebook having N sample locations for representing a plurality of pulses, where N is an integer that is substantially smaller than a maximum number of positions that can be defined by virtue of computational granularity, a method for obtaining a codebook code to represent s speech coder's quantized residual signal, comprising the steps of:

determining optimized sample locations for a plurality of pulses that comprise said code by sequentially determining, one pulse at a time, the optimum locations of individual pulses in the fixed codebook;

where the optimum location and sign of a pulse is determined by stepping through permissible ones of those of said N sample locations, evaluating the effect of placing a pulse of said permissible locations, and selecting the optimum location and sign that provides the most desired effect.

2. The speech coding method of claim 1 wherein said pulses have a fixed magnitude.

3. The speech coding method of claim 1 wherein said effect is an error signal that is obtained, for a proposed placement of a pulse in said code, by subtracting from said quantized residual signal a decoded representation of said quantized residual signal, which is developed from a previous decoded representation of said quantized residual signal which is modified by said code that includes a pulse in the proposed placement of the pulse.

4. In a speech coding method where a speech signal is encoded in frames, and where each frame is represented by one or more speech parameters, and further represented by a vector that specifies a multi-pulse signal, the improvement comprising the steps of:

determining a pulse location and a pulse sign for a pulse that most contributes to reduction of encoder error signal, where the pulse location is one of a predetermined number of pulse locations and where pulse magnitude is fixed;

assigning a single pulse, to the location determined in said step of determining, with the sign determined in said step of determining, and accounting for the contribution of said single pulse to the reduction of said encoder signal, where said assigning is performed by iteratively specifying a pulse location, evaluating a desired effect of said specifying, and carrying out said assigning to yield the most desired effect; and returning to said step of determining.

5. The method of claim 4 wherein said specifying a pulse location consults a permissions table and refrains from specifying locations that said permissions table forbids, further comprising a step, following said step of assigning, for updating said permissions table, based on said pulse assigned by said step of assigning.

6. The method of claim 5 where the updating of said permissions table follows a prescribed set of rules.

7. The method of claim 6 where the prescribed set of rules specifies that no pulses are permitted to be assigned in pulse locations that are adjacent to a location that has an assigned pulse.

8. The method of claim 6 where said pulse locations are arranged into a two-dimensional block, and the prescribed set of rules specifies that when a location in a row of said block has a pulse, all other locations in said row become disallowed pulse locations.

9. The method of claim 5, where the step of returning is carried out until no pulses can be assigned without increasing said encoder error signal.

10. In a speech coding system that operates in frames and develops a quantized residual signal for each frame, a method for developing a code for the quantized residual signal of each frame, where the code has N element positions and each element in an element position can assume the value 0, +1, or −1, where N is an integer that is substantially smaller than a maximum number of positions that can be defined by virtue of computational granularity, and where the method starts with a code where all elements have the value 0, comprising the steps of:

searching for a permissible element position where the addition of a +1 or a −1 element yields the most improvement in recovery of said quantized residual signal with the aid of said code, where the permissible element positions are specified by a permission table;

assigning an element to the element position identified by said step of searching, with a value, selected from the set of +1 and −1, that yields the most improvement in recovery of said quantized residual signal with the aid of said code;

reducing the number of permissible element positions in said permission table, based on a rule that specifies disallowed element positions based on the element position assigned in said step of assigning;

stopping said method when no permissible element locations are left in said permission table and, otherwise, returning to said step of searching.

11. The method of claim 10 further comprising a second step, interposed between said step of searching and said step of assigning, of stopping said method when said step of searching fails to find a permissible element position that yields an improvement in said recovery.

12. The method of claim 10 where said step of searching is carried out by iteratively selecting different permissible ones of said element positions, and for each selected permissible element position, evaluating said improvement for a +1 element and for a −1 element.

* * * * *